US008535109B1

(12) United States Patent
Wei et al.

(10) Patent No.: US 8,535,109 B1
(45) Date of Patent: Sep. 17, 2013

(54) METHOD FOR MAKING INCANDESCENT LIGHT SOURCE AND INCANDESCENT LIGHT SOURCE DISPLAY

(71) Applicants: Yang Wei, Beijing (CN); Shou-Shan Fan, Beijing (CN)

(72) Inventors: Yang Wei, Beijing (CN); Shou-Shan Fan, Beijing (CN)

(73) Assignees: Tsinghua University, Beijing (CN); Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/632,433

(22) Filed: Oct. 1, 2012

(30) Foreign Application Priority Data

Mar. 30, 2012 (CN) ..... 2012 1 0089739

(51) Int. Cl.
*H05B 33/02* (2006.01)

(52) U.S. Cl.
USPC ..... 445/25; 313/496; 313/311

(58) Field of Classification Search
CPC .. B82Y 40/00; H01J 29/30; H01J 2329/0431; H01L 51/48
USPC ..... 977/742, 842, 932; 313/309, 311, 313/495; 445/50–51, 46, 49; 438/151, 182
See application file for complete search history.

(56) References Cited

U.S. PATENT DOCUMENTS

| | | | | |
|---|---|---|---|---|
| 5,753,088 | A * | 5/1998 | Olk | 204/173 |
| 6,957,993 | B2 | 10/2005 | Jiang et al. | |
| 7,988,515 | B2 * | 8/2011 | Wei et al. | 445/50 |
| 7,997,950 | B2 * | 8/2011 | Wei et al. | 445/50 |
| 8,029,328 | B2 * | 10/2011 | Wei et al. | 445/50 |
| 8,246,874 | B2 * | 8/2012 | Jiang et al. | 264/103 |

* cited by examiner

*Primary Examiner* — Tracie Y Green
(74) *Attorney, Agent, or Firm* — Altis Law Group, Inc.

(57) ABSTRACT

A method for making an incandescent light source display is disclosed. Electrode pairs connected to the driving circuit are formed on a substrate. The electrode pairs are spaced from each other and located on pixel locations. Each electrode pair includes a first electrode and a second electrode. The electrode pairs are covered with a drawn carbon nanotube film. The drawn carbon nanotube film suspends between the first electrode and the second electrode and has the plurality of carbon nanotubes substantially aligned an X direction from the first electrode to the second electrode in each electrode pair. The drawn carbon nanotube film is then cut along the X direction to form at least one carbon nanotube strip in each pixel location. The drawn carbon nanotube film between any adjacent two pixel locations are broken off. The carbon nanotube strip is shrunk into a carbon nanotube wire.

17 Claims, 18 Drawing Sheets

METHOD FOR MAKING INCANDESCENT LIGHT SOURCE AND INCANDESCENT LIGHT SOURCE DISPLAY

CROSS-REFERENCE TO RELATED APPLICATIONS

This application claims all benefits accruing under 35 U.S.C. §119 from China Patent Application No. 201210089739.5, filed on 2012/3/30 in the China Intellectual Property Office.

BACKGROUND

1. Technical Field

The present disclosure relates to a method for making an incandescent light source and an incandescent light source display.

2. Description of Related Art

In order to display dynamic images, more than 24 frames should be displayed within 1 minute. Therefore, the response time of pixels in a display should be less than 41 ms (milliseconds). Usually, the response time of pixels in a liquid crystal display (LCD) can be less than 25 ms, even as little as 5 ms. The response time of pixels in a cathode ray tube (CRT) display can be just several microseconds.

Incandescent light sources are bright and efficient which can be advantageous for use in displays. However, the response time of the tungsten filament has been too slow to be used in displays. For example, the response time of a tungsten filament with a diameter of 15 μm (micrometers) is about 100 ms.

What is needed, therefore, is to provide a method for making an incandescent light source and an incandescent light source display which can display dynamic images.

BRIEF DESCRIPTION OF THE DRAWINGS

Many aspects of the embodiments can be better understood with reference to the following drawings. The components in the drawings are not necessarily to scale, the emphasis instead being placed upon clearly illustrating the principles of the present disclosure. Moreover, in the drawings, like reference numerals designate corresponding parts throughout the several views.

DETAILED DESCRIPTION

Figure 1:
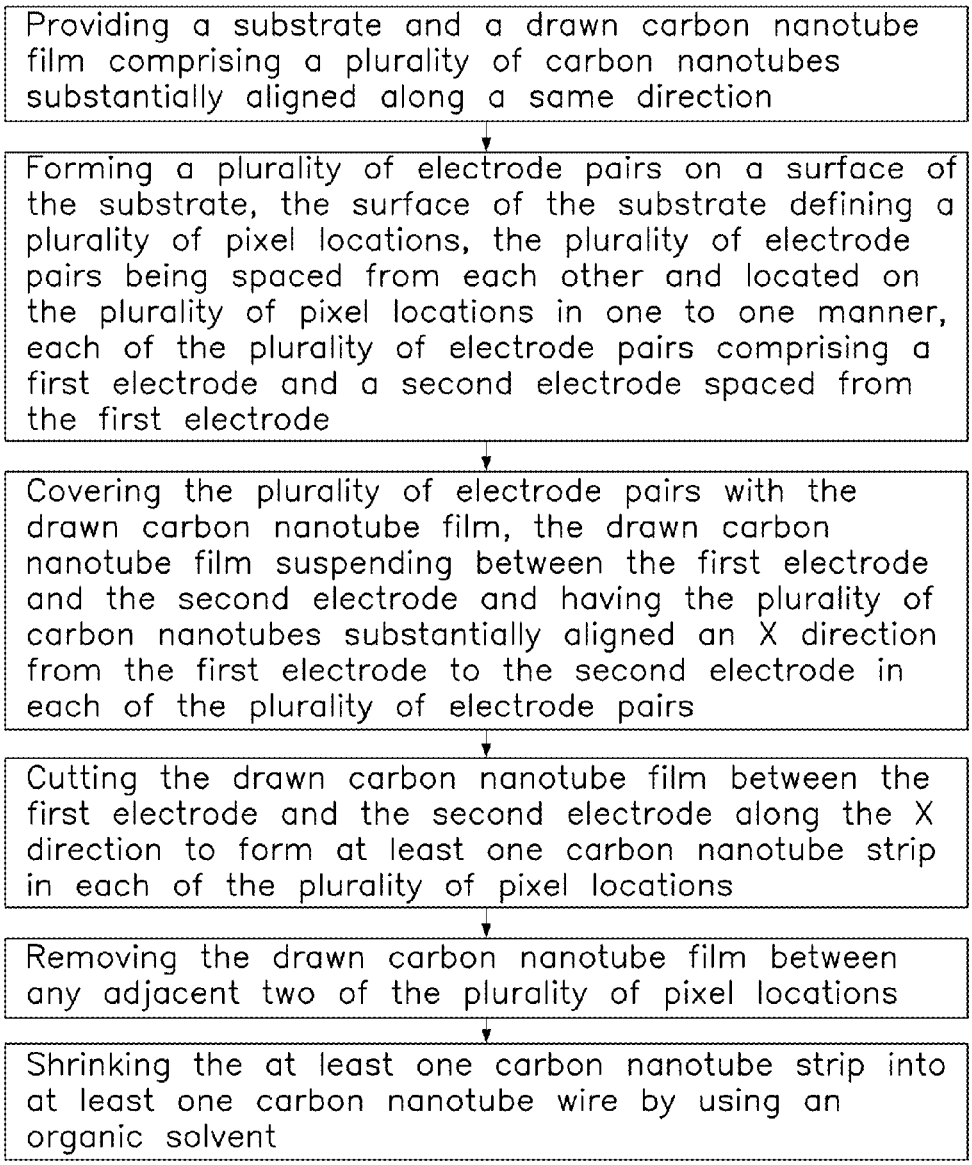
FIG. 1 is a flow chart of one embodiment of a method for making an incandescent light source display.
Figure 2:
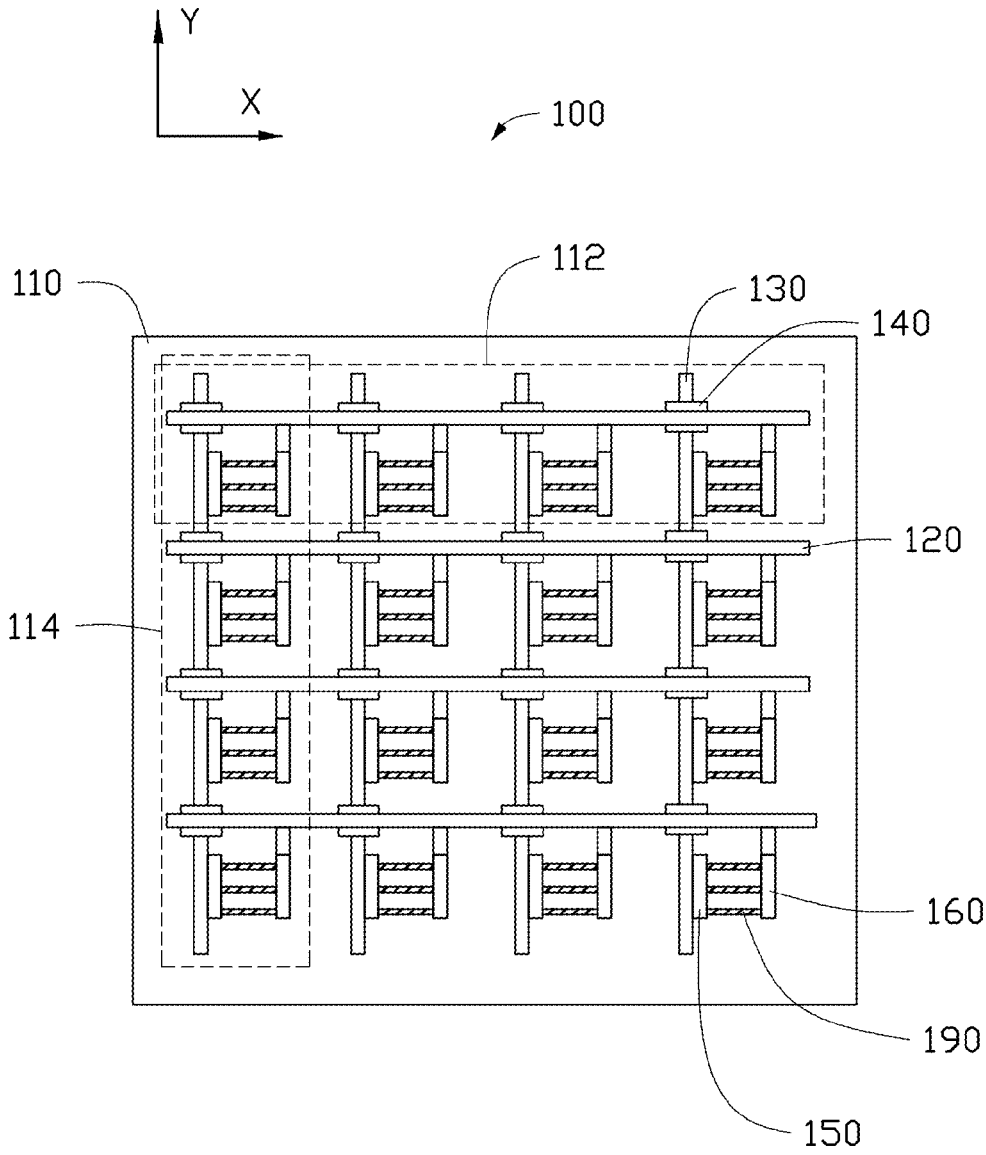
FIG. 2 is a schematic top view of one embodiment of the incandescent light source display.
Figure 3:
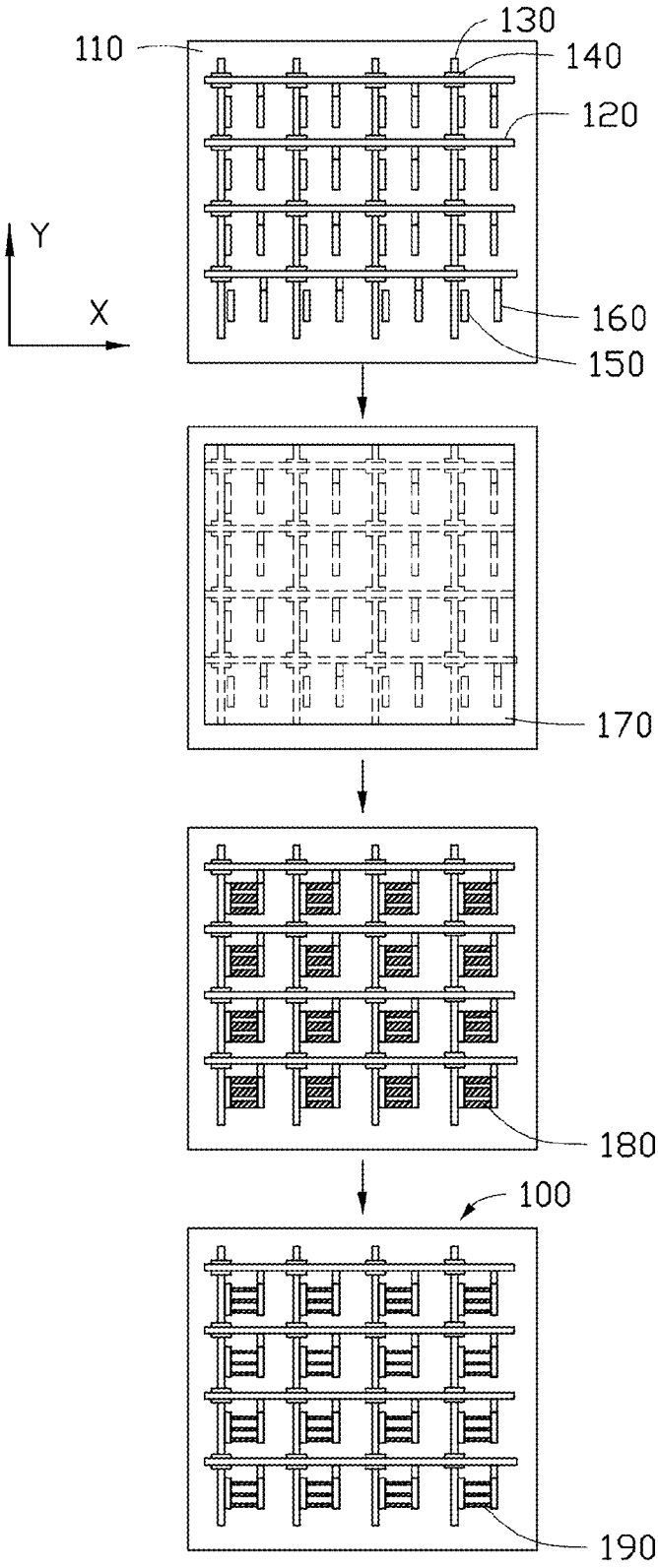
FIG. 3 is a schematic top view of one embodiment of the method for making the incandescent light source display.

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Referring to FIG. 1-3 and FIG. 11, one embodiment of a method for making an incandescent light source display 100 includes steps of:

S1, providing a substrate 110 and a drawn carbon nanotube film 170 comprising a plurality of carbon nanotubes substantially aligned along a same direction;

S2, forming a driving circuit and a plurality of electrode pairs electrically connected to the driving circuit on a surface of the substrate 110, the surface of the substrate 110 defining a plurality of pixel locations, the plurality of electrode pairs being spaced from each other and located on the plurality of pixel locations in one to one manner, each of the plurality of electrode pairs comprising a first electrode 160 and a second electrode 150 spaced from the first electrode 160;

S3, covering the plurality of electrode pairs with the drawn carbon nanotube film 170, the drawn carbon nanotube film 170 suspending between the first electrode 160 and the second electrode 150 and having the plurality of carbon nanotubes substantially aligned an X direction from the first electrode 160 to the second electrode 150 in each of the plurality of electrode pairs;

S4, cutting the drawn carbon nanotube film 170 between the first electrode 160 and the second electrode 150 along the X direction to form at least one carbon nanotube strip 180 in each of the plurality of pixel locations;

S5, removing the drawn carbon nanotube film 170 between any adjacent two of the plurality of pixel locations; and S6, shrinking the at least one carbon nanotube strip 180 into at least one carbon nanotube wire 190 by using an organic solvent.

The substrate 110 is configured for supporting the driving circuit and the plurality of electrode pairs. The substrate 110 can be made of flexible materials or rigid materials. The flexible materials may be plastics, resins or fibers. The rigid materials may be ceramics, glasses, or quartzes. The shape, size, and thickness of the substrate 110 can be chosen according to need. The substrate 110 includes a first surface and a second surface opposite to the first surface. In one embodiment, the substrate 110 is a glass substrate with a thickness of 1 mm (millimeter) and an edge length of 48 mm.

Figure 4:
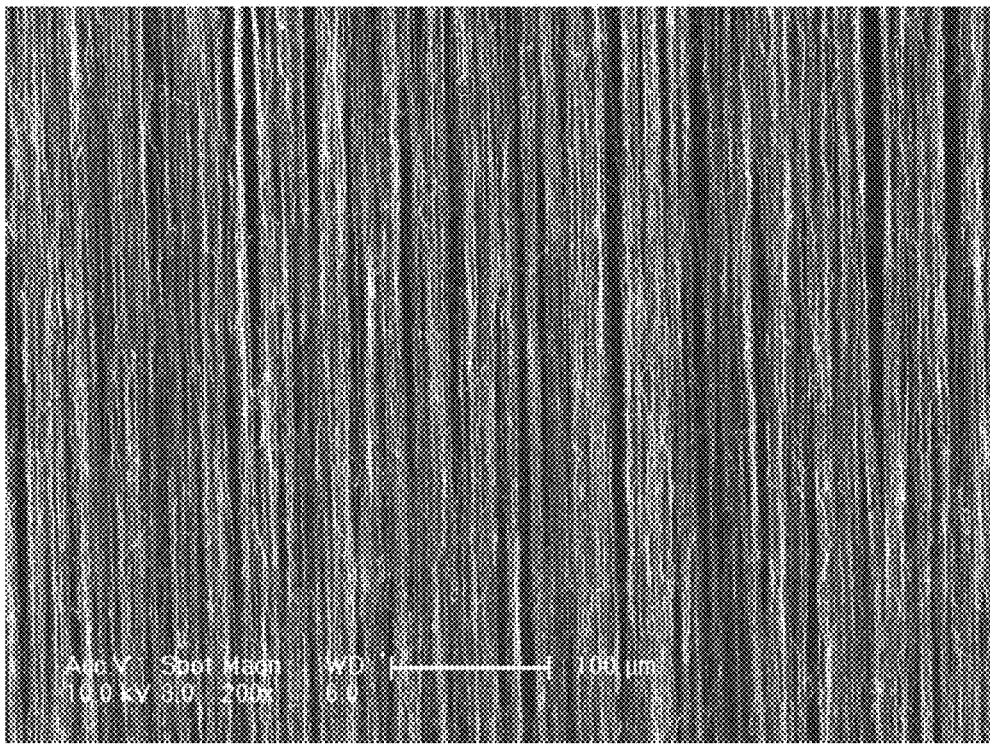
FIG. 4 is a Scanning Electron Microscope (SEM) image of a carbon nanotube film.

The drawn carbon nanotube film 170 can be drawn from a carbon nanotube array. Referring to FIG. 4, the drawn carbon nanotube film 170 can include or consist of a plurality of carbon nanotubes. In the drawn carbon nanotube film 170, the overall aligned direction of a majority of carbon nanotubes is substantially aligned along the same direction parallel to a surface of the carbon nanotube film 170. A majority of the carbon nanotubes are substantially aligned along the same direction in the carbon nanotube film 170. Along the aligned direction of the majority of carbon nanotubes, each carbon nanotube is joined to adjacent carbon nanotubes end to end by van der Waals attractive force therebetween, whereby the carbon nanotube film 170 is capable of being free-standing structure. There may be a minority of carbon nanotubes in the carbon nanotube film 170 that are randomly aligned. However, the number of the randomly aligned carbon nanotubes is very small and does not affect the overall oriented alignment of the majority of carbon nanotubes in the carbon nanotube film 170. The majority of the carbon nanotubes in the carbon nanotube film 170 that are substantially aligned along the same direction may not be exactly straight, and can be curved at a certain degree. The majority of the carbon nanotubes in the carbon nanotube film 170 that are substantially aligned along the same direction may not be exactly aligned along the overall aligned direction, and can deviate from the overall aligned direction by a certain degree. Therefore, partial contacts can exist between the juxtaposed carbon nanotubes in the majority of the carbon nanotubes aligned along the same direction in the carbon nanotube film 170. The drawn carbon nanotube film 170 may include a plurality of successive and oriented carbon nanotube segments. The plurality of carbon nanotube segments are joined end to end by van der Waals attractive force. Each carbon nanotube segment includes a plurality of carbon nanotubes substantially parallel to each other, and the plurality of parallel carbon nanotubes are in contact with each other and combined by van der Waals attractive force therebetween. The carbon nanotube segment has a desired length, thickness, uniformity, and shape. There can be clearances between adjacent and juxtaposed carbon nanotubes in the carbon nanotube film 170. A thickness of the drawn carbon nanotube film 170 at the thickest location is about 0.5 nanometers to about 100 microns (e.g., in a range from 0.5 nanometers to about 10 microns).

The term "free-standing" includes, but not limited to, a carbon nanotube film 170 that does not have to be supported by a substrate. For example, the drawn carbon nanotube film 170 can sustain the weight of itself when it is hoisted by a portion thereof without any significant damage to its structural integrity. So, if the drawn carbon nanotube film 170 is placed between two separate supporters, a portion of the drawn carbon nanotube film 170, not in contact with the two supporters, can be suspended between the two supporters and yet maintain a film structural integrity. The drawn carbon nanotube film 170 is realized by the successive carbon nanotubes joined end to end by van der Waals attractive force.

A weight density of the drawn carbon nanotube film 170 can be less than $3\times10^{-4}$ kg/m$^2$, and in one embodiment, less than $1.5\times10^{-5}$ kg/m$^2$. A heat capacity per unit area of the drawn carbon nanotube film 170 can be less than $2\times10^{-4}$ J/cm$^2$*K, and in one embodiment, less than $1.7\times10^{-6}$ J/cm$^2$*K.

The plurality of electrode pairs can be located on the first surface of the substrate 110. The first surface defines the plurality of pixel locations corresponding to a predetermined pixel matrix. For example, the plurality of pixel locations can be arranged in lines and columns to form a pixel array. Each line of the pixel locations in the pixel array is named as a pixel line 112, and each column of the pixel locations in the pixel array is named as a pixel column 114, in the present specification. In the step S2, each of the plurality of pixel locations has a first electrode 160 and a second electrode 150 formed thereon. A distance from the first electrode 160 to the second electrode 150 in the same electrode pair can be in a range from about 20 microns to about 1 centimeters (e.g., about 380 microns). The X direction represents a direction from the first electrode 160 to a second electrode 150 in the same electrode pair. The X direction in all the electrode pairs of all the pixel locations can be the same. The first electrode 160 and the second electrode 150 of the same electrode pair on all the pixel locations can be electrically connected together by only one covering step of the drawn carbon nanotube film 170.

The driving circuit can include a plurality of electrode down-leads respectively extends from the first electrode 160 and the second electrode 150 of the plurality electrode pairs to a driving unit (not shown) of the driving circuit. The electrode down-leads, the first electrode 160, and the second electrode 150 are electrically conductive, and can be made of metal, indium tin oxide, or conductive slurry. The embodiment of the method for making the incandescent light source display 100 can include steps for making the driving circuit of:

S21, forming a first electrode down-lead 120 electrically connected to the first electrode 160 on the surface of the substrate 110; and S22, forming a second electrode down-lead 130 electrically connected to the second electrode 150 on the surface of the substrate 110, wherein the first electrode down-lead 120 is electrically insulated to the second electrode down-lead 130.

In one embodiment, the driving circuit can include a plurality of first electrode down-leads 120 spaced from each other and a plurality of second electrode down-leads 130 spaced from each other. When the plurality of electrode pairs are arranged in lines and columns, each first electrode down-lead 120 is connected to the first electrode 160 of all the electrode pairs in the same pixel line 112, and each second electrode down-lead 130 is connected to the second electrode 150 of all the electrode pairs in the same pixel column 114. The plurality of first electrode down-leads 120 and the plurality of second electrode down-leads 130 are insulated from each other. The driving circuit is an addressing circuit, and it is capable of applying a voltage between the first electrode 160 and the second electrode 150 of a predetermined electrode pair through one first electrode down-lead 120 and one second electrode down-lead 130. The plurality of first electrode down-leads 120 can intercross with the plurality of second electrode down-leads 130. Furthermore, in some embodiments, the incandescent light source display 100 can include a plurality of insulators 140 located or sandwich between the first electrode down-leads 120 and the second electrode down-leads 130 to avoid short-circuiting. The insulators 140 can be located at every intersection of the first electrode down-leads 120 and the second electrode down-leads 130 for providing electrical insulation therebetween. In another embodiment, the first electrode down-leads 120 and the second electrode down-leads 130 can be respectively formed on the first surface and the second surface of the substrate 110, and thus they can be insulated from each other. When the driving circuit is formed on the second surface and the first and second electrodes 160, 150 are formed on the first surface of the substrate 110, the substrate 110 can further define a plurality of conducting through holes to electrically connect the driving circuit and the first and second electrodes 160, 150 located on different surfaces together.

The size of the first electrode 160, the second electrode 150, and the electrode down-leads 120, 130 can be decided by actual needs of resolution of the display 100. When the first electrode 160, the second electrode 150, and the electrode down-leads 120, 130 are formed on the same surface of the substrate 110, the height of the first electrode 160 and the second electrode 150 can be larger than the thickness of the electrode down-leads 120, 130. Therefore, the carbon nanotube film 170 can be supported solely by the first and second electrode 160, 150, and suspend at the rest portion.

In one embodiment, at least one of the first electrode 160 and the second electrode 150 can be a thermal dissipation electrode, to quickly dissipate the heat of a carbon nanotube wire in contact with the at least one of the first electrode 160 and the second electrode 150. The thermal dissipation electrode has a relatively large bulk to absorb relatively more heat. A height of the thermal dissipation electrode can be in a range from about 10 microns to about 100 microns.

The first electrode 160, the second electrode 150, and the electrode down-leads 120, 130 can be formed by screen printing method, laser printing method, sputtering and etching method, plating method, or evaporating method.

In one embodiment, the first electrode 160, the second electrode 150, and the electrode down-leads 120, 130 are formed by the screen printing method on the first surface of the substrate 110. The first electrode 160 and the second electrode 150 are formed by repeating the screen printing to achieve a desired height, which is larger than the thickness of the electrode down-leads 120, 130. The first electrode down-leads 120 can be parallel to each other and aligned along the X direction. The second electrode down-leads 130 can be parallel to each other and aligned along a Y direction. An angle between the X direction and the Y direction can range from about 10 degrees to about 90 degrees. In one embodiment, the angle is 90 degrees to define a plurality of square pixel locations on the first surface of the substrate 110. The first electrode down-leads 120 can be located equidistantly apart. A distance between adjacent two first electrode down-leads 120 can range from about 50 μm to about 2 cm (centimeters). The second electrode down-leads 130 are located equidistantly apart. A distance between adjacent two second electrode down-leads 130 can range from about 50 μm to about 2 cm.

The insulators 140 at every intersection of the first and second electrode down-leads 120, 130 can also be formed by the screen printing method, laser printing method, sputtering and etching method, plating method, or evaporating method.

In the step S3, the carbon nanotube film 170 can have an enough size to cover the plurality of electrode pairs, and can be in contact with the top surface of the plurality of electrode pairs. By the support of the electrode pairs, the carbon nanotube film 170 is spaced from the surface of the substrate 110 and suspend between the first electrode 160 and the second electrode 150. The carbon nanotube film 170 is covered on the electrode pairs along the X direction to make the carbon nanotubes of the carbon nanotube film 170 substantially aligned along the X direction.

The carbon nanotube film 170 is adhesive in nature and can be adhered to the first electrode 160 and the second electrode 150 directly. The carbon nanotube film 170 has a good conductivity and electrically contacts with the first and second electrodes 160, 150. In another embodiment, before covering the carbon nanotube film 170 to the electrode pairs, a conducting binder can be further coated on the top surface of the first and second electrodes 160, 150. The carbon nanotube film 170 can be firmly combined with the first and second electrodes 160, 150 by the conducting binder. The conducting binder can have the carbon nanotube film 170 embedded therein before being cured. In another embodiment, after covering the carbon nanotube film 170, an additional step of forming a fixing member on each of the first and second electrodes 160, 150 can be further processed. The carbon nanotube film 170 can be located between or sandwiched between the first and second electrodes 160, 150 and the fixing members. The fixing members also can be formed by the screen printing method, laser printing method, sputtering and etching method, plating method, or evaporating method.

In one embodiment of the step S4, only the suspended portion of the carbon nanotube film 170 between the first electrode 160 and the second electrode 150 of each electrode pair is cut into the at least one carbon nanotube strip 180. The carbon nanotube film 170 can be cut by a laser beam or an electron beam.

More specifically, the laser beam or the electron beam is focused on the surface of the carbon nanotube film 170 thus etches the focused carbon nanotube film 170 out. The focused portion of the carbon nanotube film 170 can be heated by the laser beam or the electron beam and can be reacted with the oxygen gas in air at the elevated temperature to become a carbon dioxide gas. In one embodiment, the power of the laser beam can be in a range from about 2 watts to about 50 watts. The scanning speed of the laser beam can be in a range from about 0.1 mm/s to about 10000 mm/s A diameter of the laser beam can be in a range from about 1 micron to about 400 microns. In one embodiment, the laser beam is generated by an yttrium aluminum garnet laser device having a wavelength of about 1.06 microns, a power of about 3.6 watts, and a scanning rate of about 100 mm/s The laser beam or electron beam scans the surface of the carbon nanotube film 170 along the X direction to cut the carbon nanotube film 170. The suspended carbon nanotube film 170 can be cut into a plurality of carbon nanotube strips 180 spaced from each other between the first electrode 160 and the second electrode 150. The carbon nanotube strip 180 has a similar structure to the carbon nanotube film 170 with a narrower width. The scanning direction of the laser beam is substantially along the aligned direction of the carbon nanotubes in the carbon nanotube film 170. The two opposite ends of the carbon nanotube strip 180 are respectively connected to the first electrode 160 and the second electrode 150.

Figure 5:
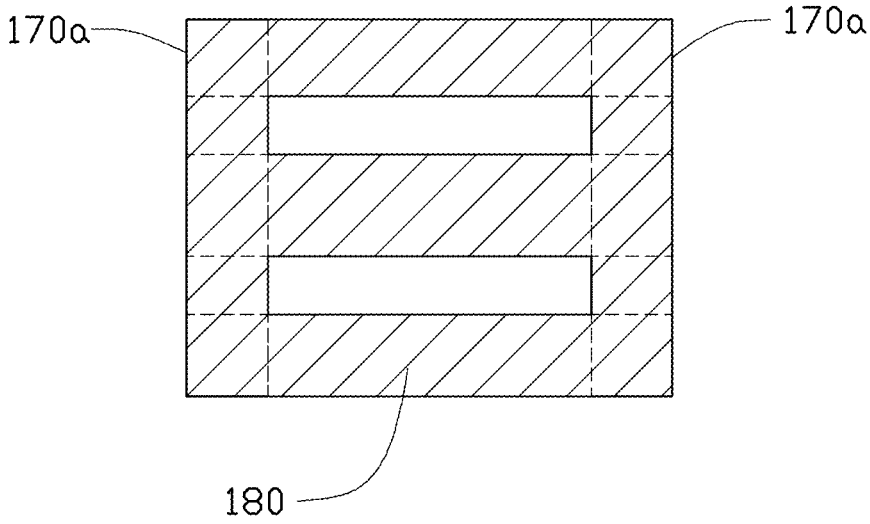
FIG. 5 is a schematic top view of one embodiment of the carbon nanotube film after a laser scanning step in the embodiment of the method for making the incandescent light source display.
Figure 6:
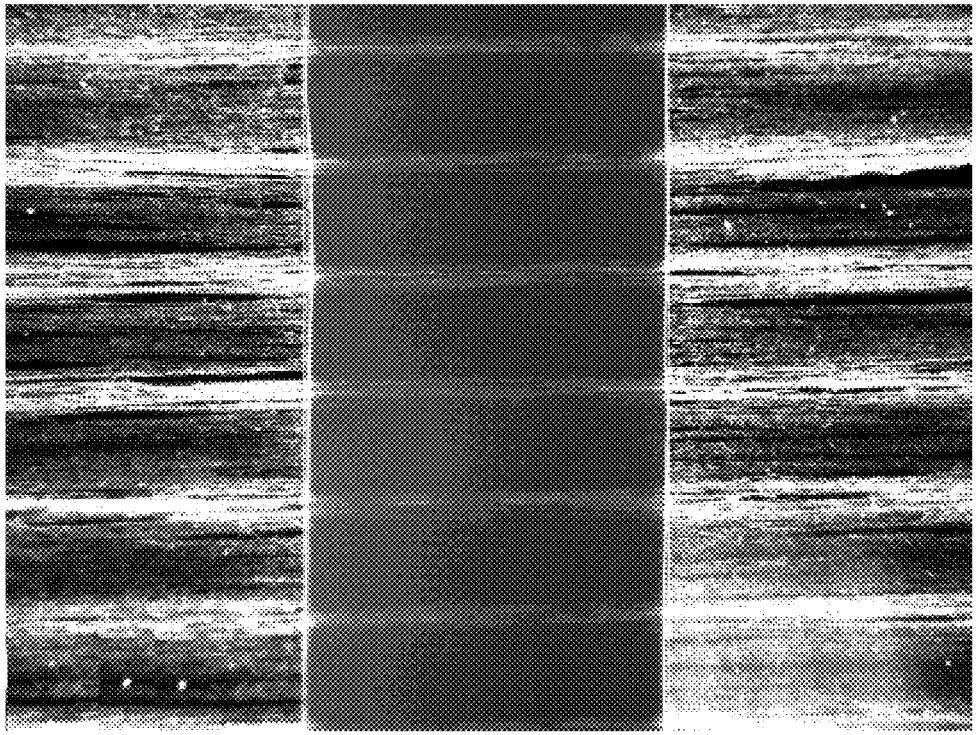
FIG. 6 is an optical microscope image of a plurality of carbon nanotube strips formed in the embodiment of the method for making the incandescent light source display.

The cutting of the carbon nanotube film 170 can be continuously processed at all pixel locations. In one embodiment, the plurality of electrode pairs are arranged in parallel lines and parallel columns to form the pixel array and the X direction is parallel to the pixel lines 112, and the laser beam or the electron beam scans the carbon nanotube film 170 pixel line by pixel line 112. The laser beam or the electron beam scans across all the electrode pairs in the same pixel line 112. Referring to FIG. 5 and FIG. 6, the suspended portion of carbon nanotube film 170 can be etched out by the scanning; however, the portion 170*a* of the carbon nanotube film 170 in contact with the surface of the first and second electrodes 160, 150 may not be completely etched, because of the heat absorption of the first and second electrodes 160, 150. Thus, the portion 170*a* of the carbon nanotube film 170 is not totally removed after the scanning and thus connects the plurality of spaced carbon nanotube strips 180 in the same pixel location together.

The laser beam or the electron beam can scan the carbon nanotube film 170 for several times to form a plurality of carbon nanotube strips 180 in one electrode pair. The laser beam or the electron beam can continuously go through all the pixel locations in the same pixel line 112 of the pixel matrix at one time. The scanning of the carbon nanotube film 170 is processed pixel line 112 by pixel line 112, to form at least one carbon nanotube strip 180 between the first electrode 160 and the second electrode 150 at all pixel locations.

A width of the carbon nanotube strip 180 can be in a range from about 3 microns to about 30 microns. In one embodiment, the width of the carbon nanotube strip 180 is about 30 microns, and a distance between two adjacent carbon nanotube strips 180 in the same pixel locations is about 120 microns. The width of the carbon nanotube strip 180 and the distance between two adjacent carbon nanotube strips 180 in the same pixel locations can be varied according to actually needs.

The step S5 can be processed by using a laser beam or an electron beam similar to that in the step S4. The laser beam or electron beam can scan the carbon nanotube film 170 between the adjacent pixel locations to remove the carbon nanotube film 170. Therefore, the carbon nanotube strips 180 of different pixel locations can be separated from each other. It is to be understood that the carbon nanotube strips 180 of the same pixel locations are still connected together by the portion 170*a* of the carbon nanotube film 170.

When the pixel locations are arranged in the pixel array, the step S5 can further includes steps of:

S51, scanning the carbon nanotube film 170 between each adjacent two pixel lines 112; and S52, scanning the carbon nanotube film 170 between each adjacent two pixel columns 114.

Additionally, the step S5 can further include a step of removing all the carbon nanotube film 170 between any adjacent pixel locations. In one embodiment, only the carbon nanotube strips 180 between the first and second electrodes 160, 150 and the portion 170*a* of the carbon nanotube film 170 in contact with the top surface of the first and second electrodes 160, 150 are left. For example, in the step S5, after the scanning, the residual carbon nanotube film 170 between the adjacent pixel locations can be removed by using an adhesive tap or tweezers.

It is to be noted that, an order of the steps S4 and S5 can be changed, or the steps S4 and S5 can be processed simultaneously.

Figure 7:
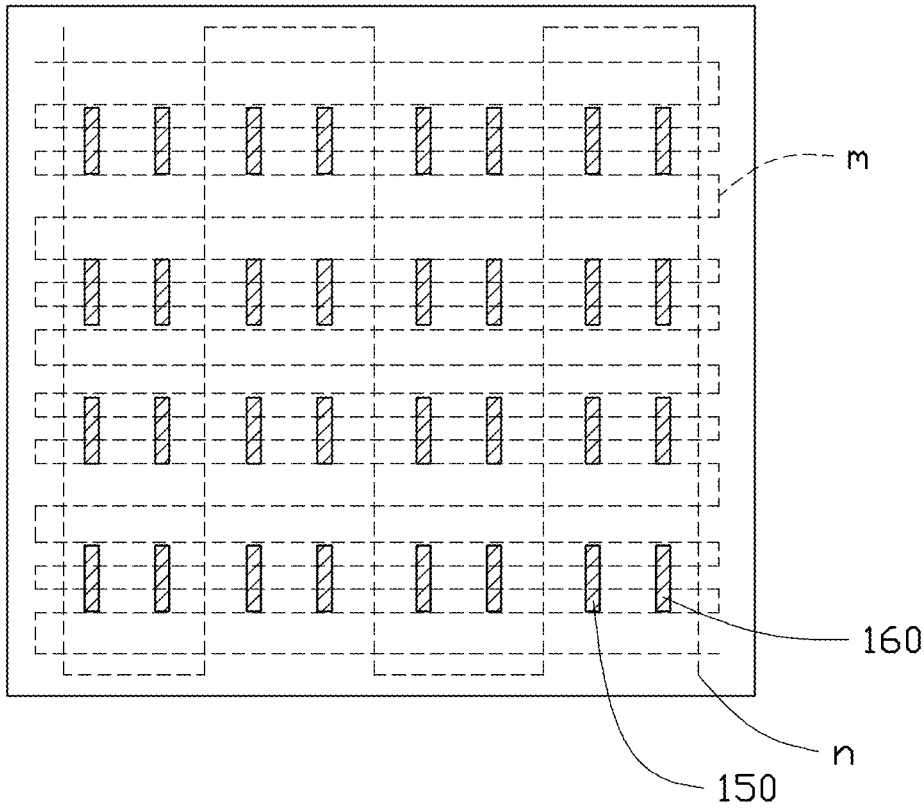
FIG. 7 is a schematic top view of one embodiment of a laser scanning route in the embodiment of the method for making the incandescent light source display.

Referring to FIG. 7, the dot lines m and n represent the cutting route of the carbon nanotube film 170. When there are n pixel lines defined on the substrate 110 and one by one counted from 1 to n, pixel line i means one some pixel line in the n pixel lines, and pixel line i+1 means the next pixel line directly adjacent to the pixel line i. The cutting route m goes through the same pixel line i several times to cut the carbon nanotube film 170 of the same pixel line into a plurality of carbon nanotube strips 180. After the pixel line i and before the pixel line i+1, the cutting route m goes between the pixel line i and the pixel line i+1, to break off the carbon nanotube film 170 between the pixel line i and the pixel line i+1. The cutting route n goes between adjacent pixel columns 114 to break off the carbon nanotube film 170 between the adjacent pixel columns 114.

Figure 8:
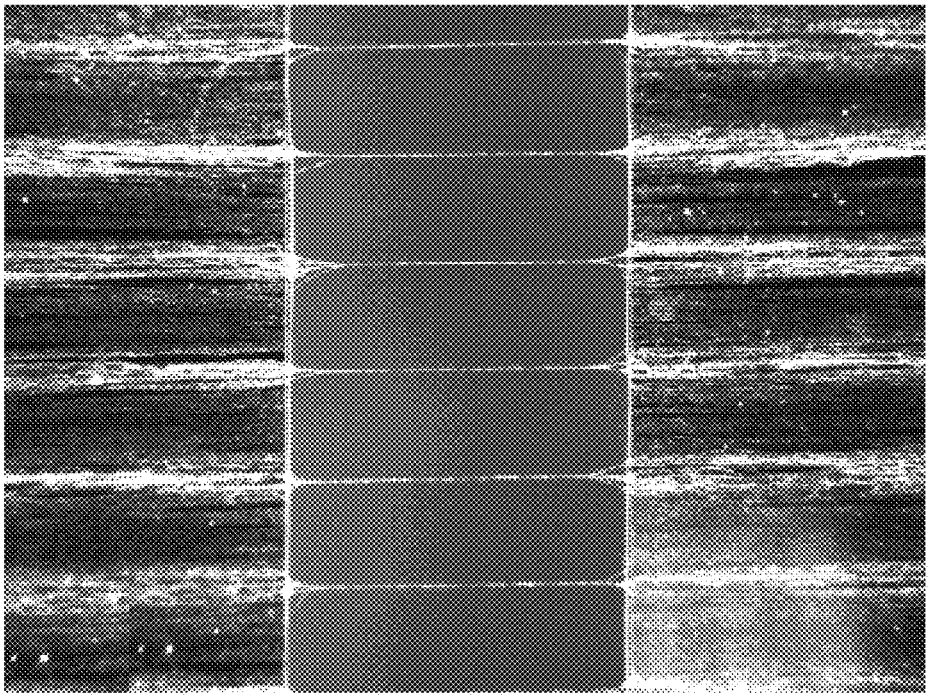
FIG. 8 is an optical microscope image of a plurality of carbon nanotube wires formed in the embodiment of the method for making the incandescent light source display.
Figure 9:
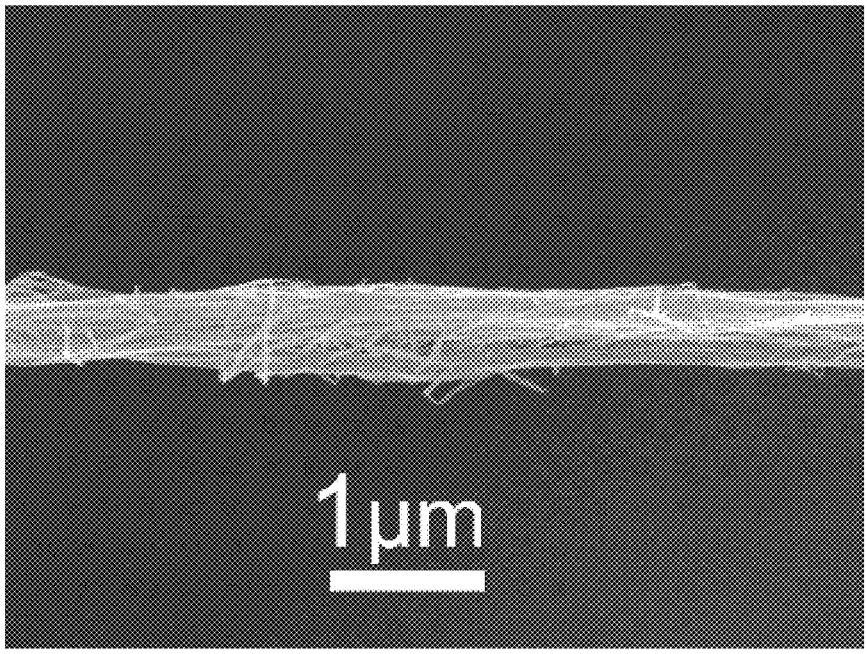
FIG. 9 is an SEM image of the carbon nanotube wire.

In the step S6, the carbon nanotube strip 180 can be soaked with the organic solvent. The surface tension of the organic solvent during the evaporation or volatilization of the organic solvent from the carbon nanotube strip 180 causes the carbon nanotube strip 180 shrinking into the carbon nanotube wire 190. The organic solvent can be a volatile solvent at room temperature such as an ethanol, methanol, acetone, dichloroethane, chloroform, or any appropriate mixture thereof. The carbon nanotube strip 180 is wet to the organic solvent. In one embodiment of the step S6, the organic solvent is dropped on the surface of the suspended carbon nanotube strip 180. In another embodiment, the substrate 110 with the carbon nanotube strips 180 is immersed in the organic solvent and then took out from the organic solvent. In another embodiment, the organic solvent is atomized into a fine spray around the carbon nanotube strips 180 to soak the carbon nanotube strips 180. In the formed carbon nanotube wire 190, the carbon nanotubes are compactly combined by van der Waals attractive force and parallel to each other, and have fewer interspaces between adjacent carbon nanotubes than the carbon nanotube strips 180 and the carbon nanotube film 170. However, the portion 170*a* of the carbon nanotube film 170 in contact with the first and second electrodes 160, 150 is hardly shrunk, but maintains the original film shape thereof and combined with the first and second electrodes 160, 150 tighter. Referring to FIG. 8 and FIG. 9, due to the connection between the two opposite ends of the carbon nanotube strip 180 and the portion 170*a* of the carbon nanotube film 170, the carbon nanotube strip 180 at the ends is gradually changed into the carbon nanotube wire 190 from the end to the middle. Thus, the carbon nanotube wire 190 has a taper shaped structure at the ends and a uniform wire shaped middle portion. The taper shaped structure has a wider end connected to the portion 170*a* and a narrower end connected to the middle portion of the carbon nanotube wire 190. The width of the carbon nanotube strip 180 can be controlled by the cutting of the carbon nanotube film 170, thus can control the diameter of the carbon nanotube wire 190. A diameter of the middle portion of the carbon nanotube wire 190 can be less than or equal to 5 microns. In one embodiment, the diameter of the middle portion of the carbon nanotube wire 190 is in a range from about 100 nanometers to about 1 micron. The plurality of carbon nanotube strips 180 are shrunk into a plurality of carbon nanotube wires 190 in one to one manner. When the carbon nanotube strips 180 are parallel to each other, the formed carbon nanotube wires 190 are also parallel to each other. In one embodiment, the width of the carbon nanotube strip 180 is about 30 microns, and the diameter of the formed carbon nanotube wire 190 is about 1 micron. Compared with the carbon nanotube strip 180, the carbon nanotube wire 190 has less specific surface area, is less adhesive, and is more durable. Additionally, the carbon nanotube strip 180 may have a defect in a local place due to the uneven distribution of the carbon nanotubes. If the carbon nanotube strip 180 is directly used in an incandescence light source to emit incandescence light, the defect may have a locally high resistance and cause a burned down of the carbon nanotube strip 180 due to a locally high temperature. The shrinking of the carbon nanotube strip 180 can remove the defect.

Figure 10:
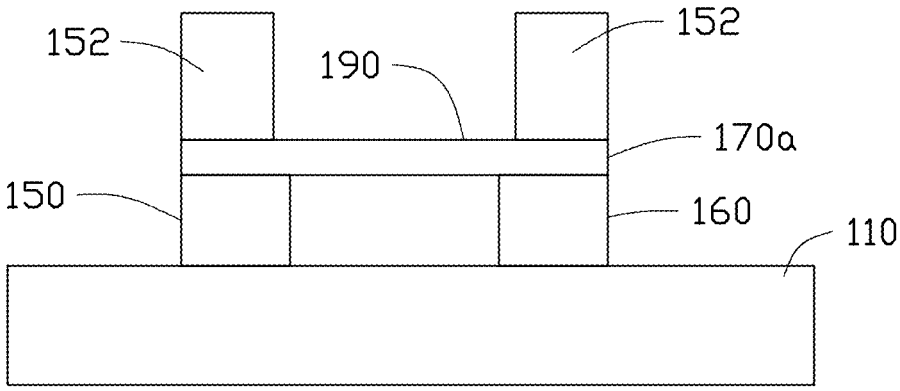
FIG. 10 is a schematic side view of one embodiment of the incandescent light source display including a heat dissipation device.

Referring to FIG. 10, the method for making the incandescent light source display 100 can further include an additional step of forming a heat dissipation device 152 to rapidly cool the carbon nanotube wire 190 down while working. The heat dissipation device can be in direct contact with the carbon nanotube wire 190 or in contact with at least one of the first and second electrode 160, 150, which conduct the heat generated from the carbon nanotube wire 190 to the heat dissipation device. The heat dissipation device can be formed on the portion 170*a* of the carbon nanotube film 170 that is in contact with at least one of the first and second electrodes 160, 150.

The method for making the incandescent light source display 100 can further include an additional step of sealing the substrate 110 with the first and second electrodes 160, 150, the driving circuit, and the carbon nanotube wires 190 in vacuum or a protective gas in a sealing case. The protective gas can be an inert gas or a nitrogen gas.

The method for making the incandescent light source display 100 can avoid placing the formed carbon nanotube wires one by one on different desired place of the substrate 110. The method forms the carbon nanotube wires 190 directly on the desired place at the same time. Further, the method can adjust the diameter of the carbon nanotube wire easily by cutting the carbon nanotube film into desired width of carbon nanotube strips 180.

Figure 11:
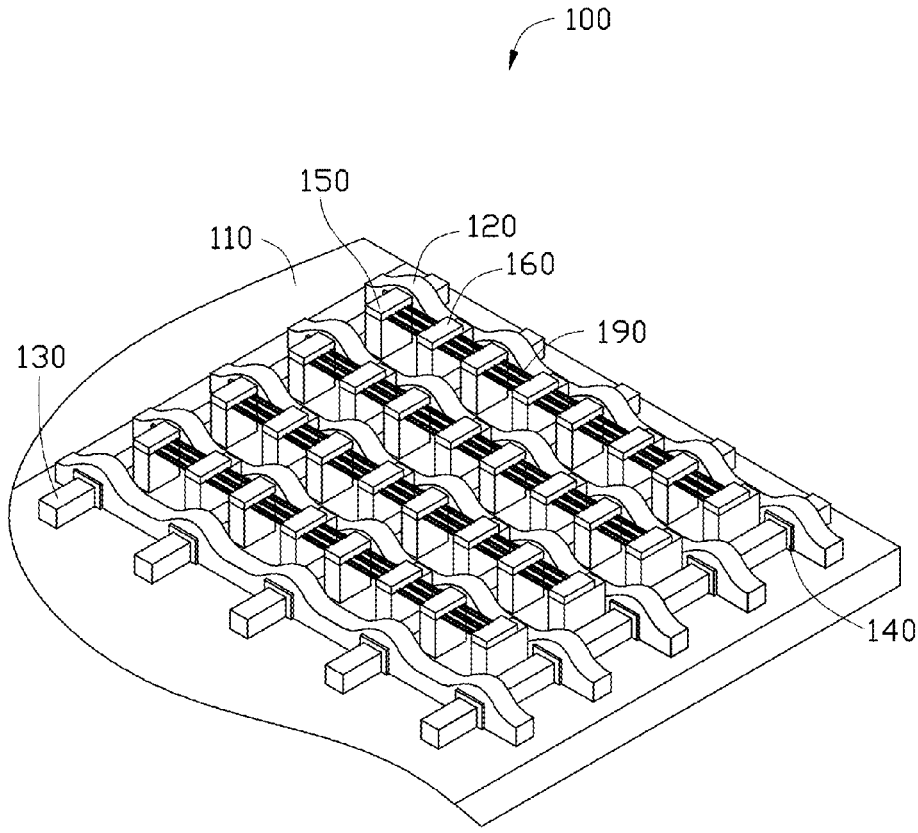
FIG. 11 is an isotropic view of one embodiment of the incandescent light source display.

Referring to FIG. 11, the incandescent light source display 100 includes the substrate 110, the driving circuit, and a plurality of pixel elements located on a surface of the substrate 110 according to a predetermined pixel matrix. Each pixel element includes one first electrode 160, one second electrode 150, and at least one carbon nanotube wire 190. The first electrode 160 is spaced from the second electrode 150. The at least one carbon nanotube wire 190 is suspended between the first electrode 160 and the second electrode 150 and connects the first electrode 160 and the second electrode 150 at two opposite ends. The driving circuit is connected to the first and second electrodes 160, 150 of every pixel elements, to apply a voltage or a current to the carbon nanotube wire 190. The driving circuit can look up the address of every pixel elements. The carbon nanotube wire 190 is spaced from the substrate 110 by the first and second electrodes 160, 150. A distance between the carbon nanotube wire 190 and the surface of the substrate 110 can be larger than or equal to 1 micron.

The plurality of pixel elements can be arranged in lines and columns. The driving circuit can include a plurality of first electrode down-leads 120, electrically and mechanically connected to the first electrodes 160, and a plurality of second electrode down-leads 130, electrically and mechanically connected to the second electrodes 150. A direction from the first electrode 160 to the second electrode 150 can be the same as the pixel line 112. The incandescent light source display 100 further has a portion 170*a* of carbon nanotube film 170 located on the top surface of the first and second electrodes 160, 150, and connected to the carbon nanotube wire 190 between the first and second electrodes 160, 150. The carbon nanotube wire 190 has a taper shaped structure at the two opposite ends and a uniform wire shaped middle portion. The taper shaped structure has a wider end connected to the portion 170*a* and a narrower end connected to the middle portion of the carbon nanotube wire 190. In the carbon nanotube wire 190, the plurality of carbon nanotubes forms an electrically conducting network. Each pixel element can include a plurality of carbon nanotube wires 190 parallel to and spaced from each other.

The first and second electrodes 160, 150 can have a relatively large height or a large bulk to increase heat capacity. Thus, the heat generated from the carbon nanotube wires 190 can be conducted to the first and second electrodes 160, 150 and the temperature of the carbon nanotube wires 190 can be decreased rapidly.

Further, the incandescent light source display 100 can include a heat dissipation device. The heat generated by the carbon nanotube wire 190 in use can be conducted to the heat dissipation device. The heat dissipation device can be in directly contact with the carbon nanotube wire 190, or in contact with at least one of the first electrode 160 and the second electrode 150.

Furthermore, the incandescent light source display 100 can include a sealing case (not shown) having a hollow space therein accommodating the substrate 110, the first and second electrodes 160, 150, the driving circuit, and the carbon nanotube wires 190. The hollow space can be vacuum or filled with the inert gas.

To test the incandescent light source display 100, a voltage of 10.25V is applied between the first electrode 160 and the second electrode 150, and a direct current is conducted through the carbon nanotube wire 190 by the first electrode 160 and the second electrode 150. The carbon nanotube wire 190 can be heated to about 2250K, and the temperature of the carbon nanotube wire 190 increases linearly with the voltage between the first electrode 160 and the second electrode 150. During the heating, the middle portion of the carbon nanotube wire 190 is the brightest, and the two opposite ends of the carbon nanotube wire 190 are the darkest. This is because of the heat dissipation of the first and second electrodes 160, 150 to make the carbon nanotube wire 190 have the lowest temperature at the two ends.

Figure 12:
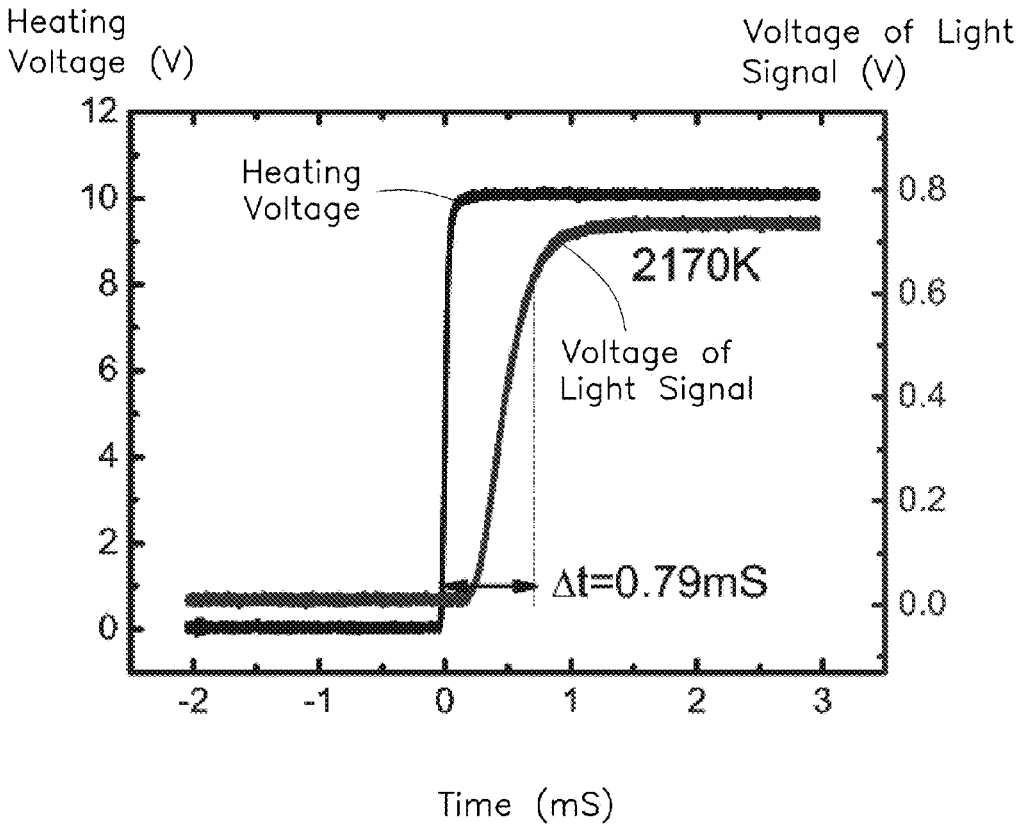
FIG. 12 shows an illuminating performance of one embodiment of the incandescent light source display during heating.
Figure 13:
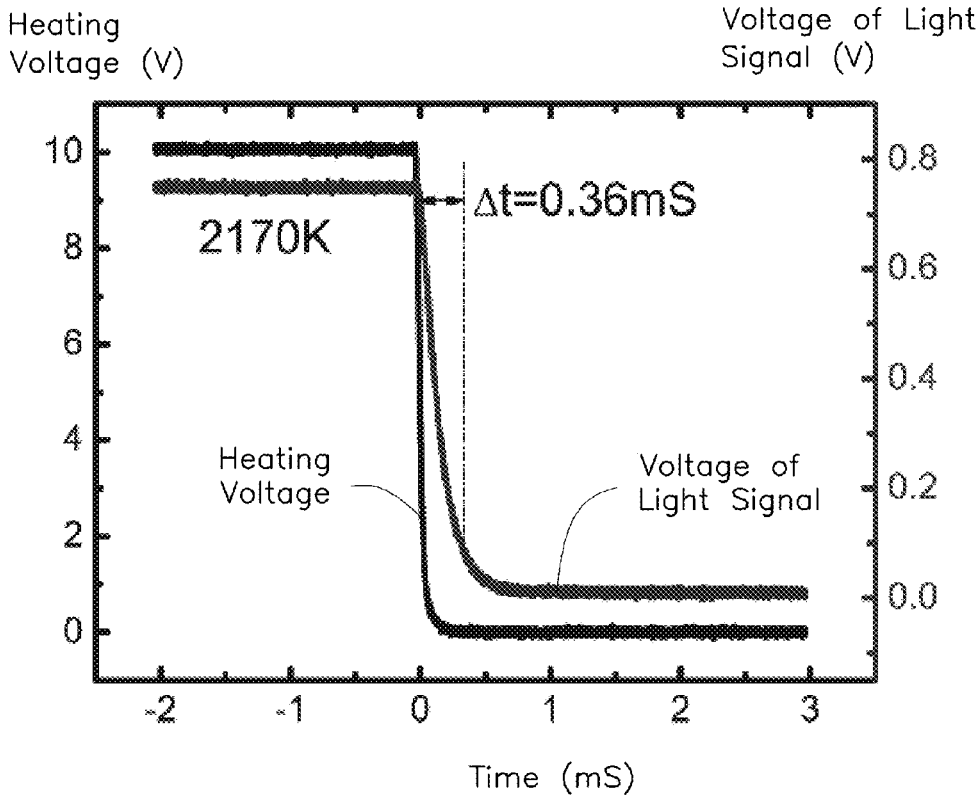
FIG. 13 shows an illuminating performance of one embodiment of the incandescent light source display during cooling.

The carbon nanotube wire 190 has a very short response time when applied by a pulsed voltage, because of a relatively small heat capacity per unit area, relatively large specific surface area, and relatively large heat coefficient of thermal radiation thereof. Therefore, the carbon nanotube wire 190 having the very short response time can be used to display dynamic images. To test the response time of the carbon nanotube wire 190, a photodiode is arranged adjacent to the carbon nanotube wire 190. Referring to FIG. 12 to FIG. 16, the horizontal axes represent times, the left longitudinal axes represent voltages that are applied to the carbon nanotube wire 190, the right longitudinal axes represent voltages of the incandescent light signals tested by the photodiode. As shown in FIG. 12 and FIG. 13, the time for the carbon nanotube wire 190 to increase the temperature from room temperature to about 2170K (i.e., the time for illuminating) under the voltage of 10V is about 0.79 milliseconds. The time for the carbon nanotube wire 190 to naturally decrease the temperature from about 2170K to room temperature (i.e., the time of quenching) by unloading the voltage is about 0.36 milliseconds. The first and second electrodes 160, 150 can be the heat dissipation electrodes, and can effectively absorb the heat generated by the carbon nanotube wire 190. The carbon nanotube wire 190 is connected to the portion 170*a* of the carbon nanotube film 170 at the two opposite ends. Thus, the heat can be rapidly conducted from the carbon nanotube wire 190 to the first and second electrodes 160, 150, and induce a shorter time of quenching.

Figure 14:
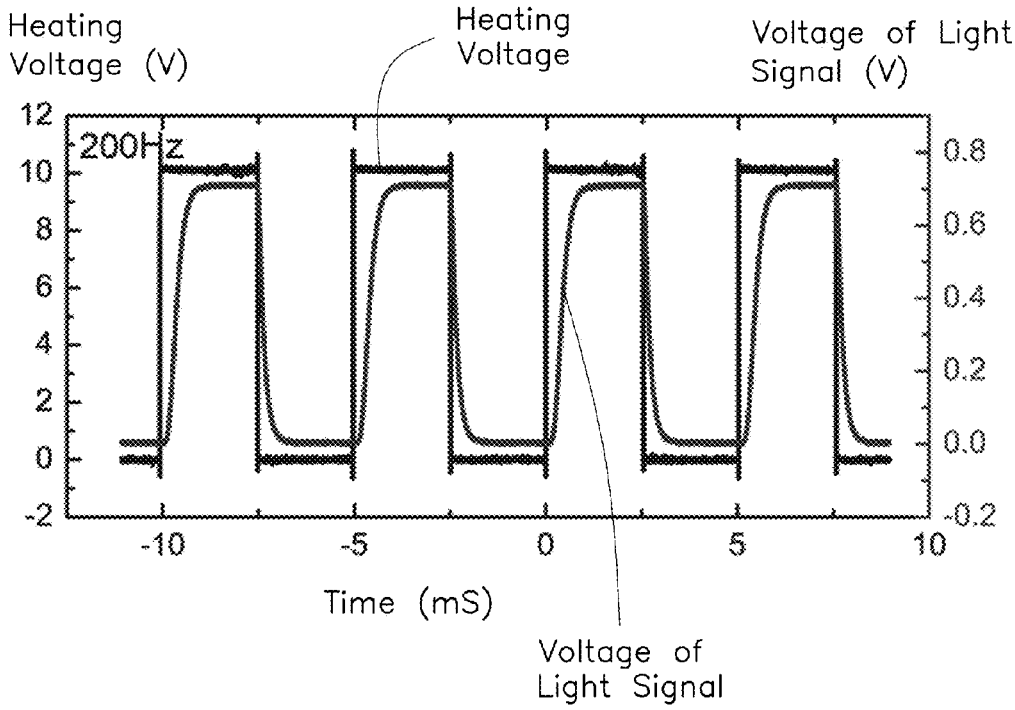
FIG. 14 shows an illuminating response curve of one embodiment of the incandescent light source display to a heating voltage in a frequency of 200 Hz.
Figure 15:
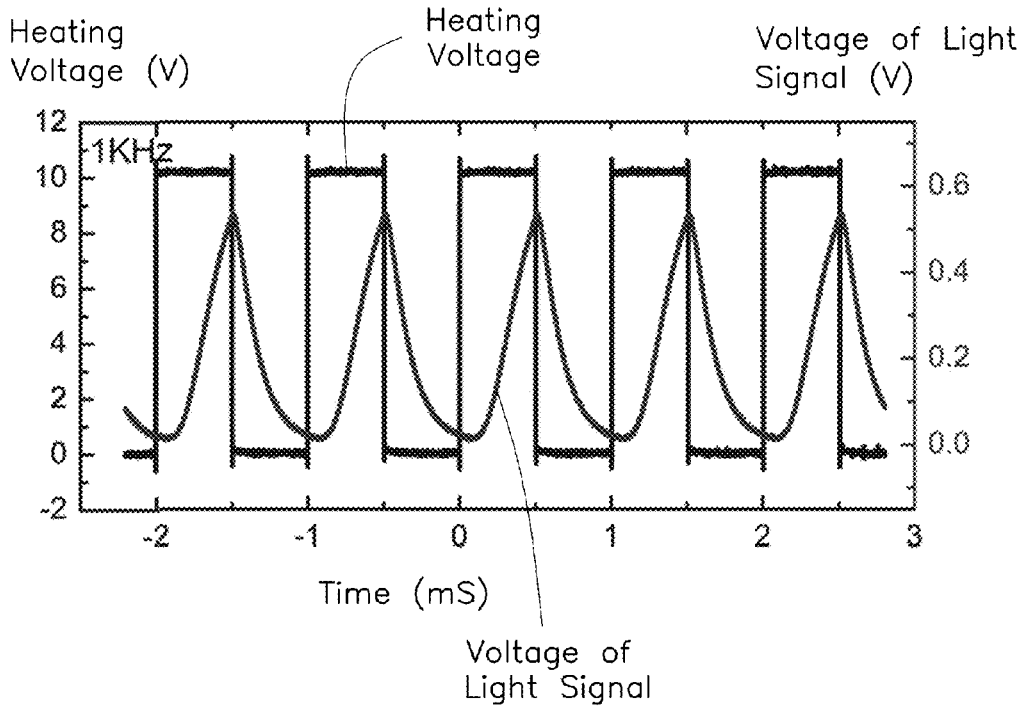
FIG. 15 shows an illuminating response curve of one embodiment of the incandescent light source display to a heating voltage in a frequency of 1 KHz.
Figure 16:
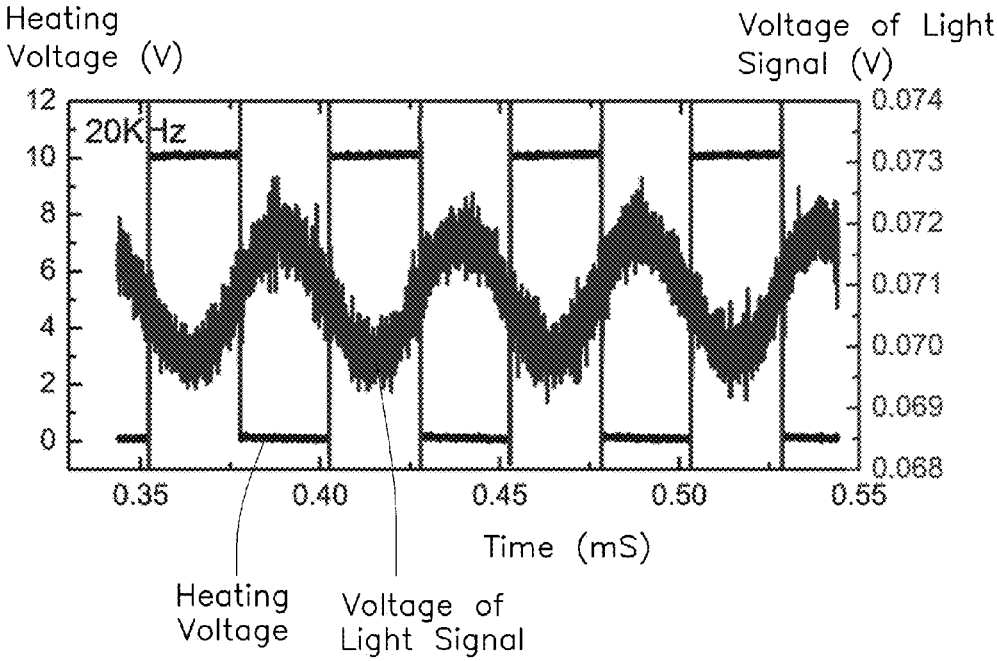
FIG. 16 shows an illuminating response curve of one embodiment of the incandescent light source display to a heating voltage in a frequency of 20 KHz.

Referring to FIG. 14 to FIG. 16, square wave voltages of 10 V having different frequencies are applied to the carbon nanotube wire 190. When the frequency is about 200 Hz, the voltage of the incandescent light signal also shows a quasi-square wave form. When the frequency is about 1 kHz, the voltage of the incandescent light signal shows a triangle wave form. When the frequency is about 20 kHz, the voltage of the incandescent light signal shows a sine wave form. The response speed of the carbon nanotube wire 190 is very fast.

Figure 17:
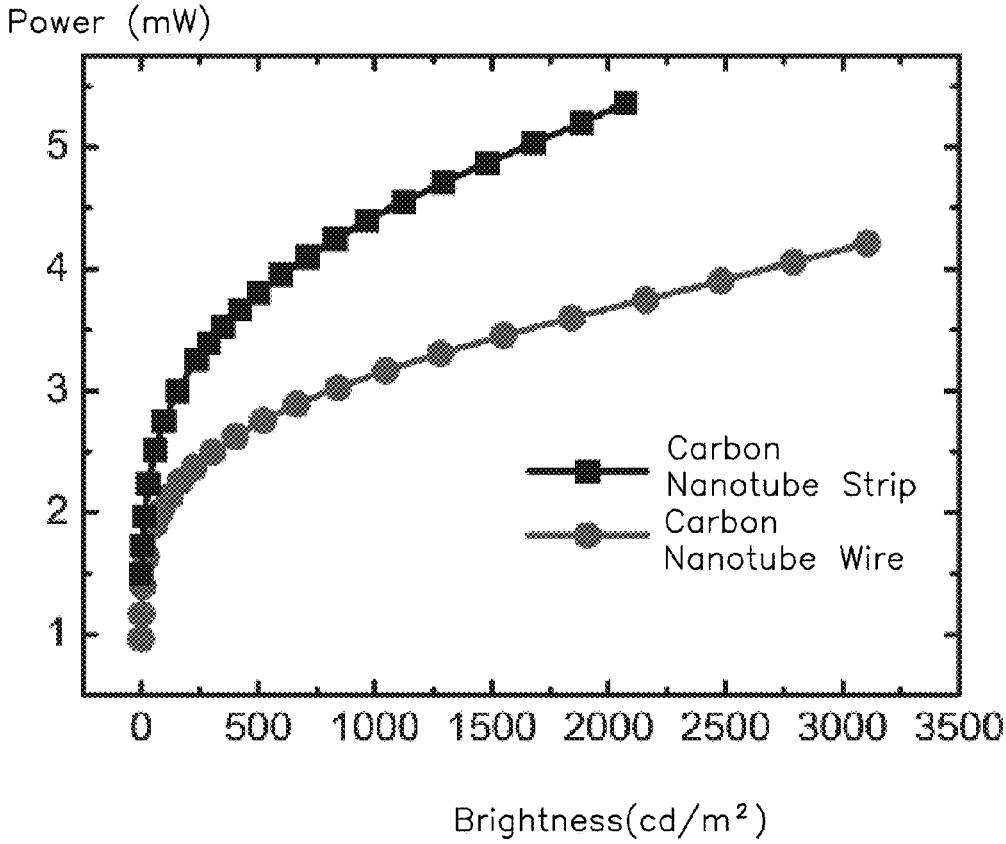
FIG. 17 shows power-brightness curves of embodiments of the incandescent light source displays respectively using carbon nanotube films and carbon nanotube wires.
Figure 18:
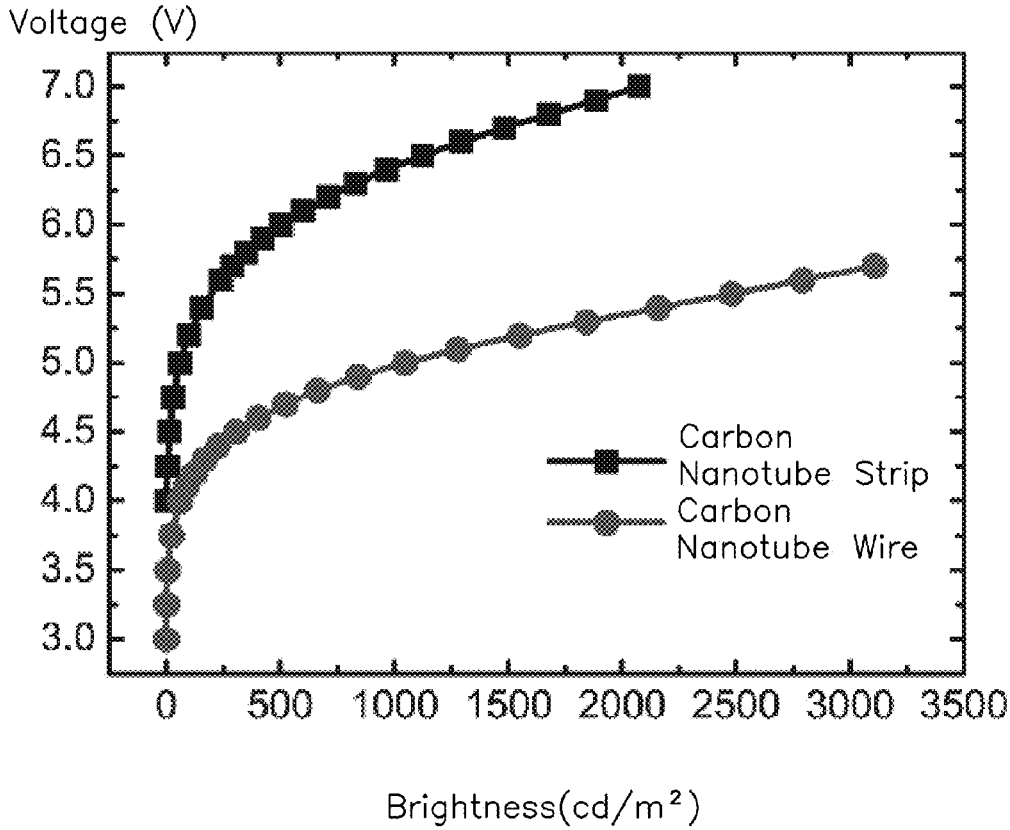
FIG. 18 shows voltage-brightness curves of embodiments of the incandescent light source displays respectively using carbon nanotube films and carbon nanotube wires.

Compared with the incandescent light source display 100 using the carbon nanotube strips 180, the incandescent light source display 100 using the carbon nanotube wires 190 has a lower working voltage and lower power consumption. Referring to FIG. 17 and FIG. 18, to heat the carbon nanotube wire 190 and the carbon nanotube strip 180 to the same brightness, the voltage and the power for the carbon nanotube wire 190 are both smaller. For having a brightness of about 1000 cd/m$^2$ of the carbon nanotube wire 190 and the carbon nanotube strip 180, the power consumptions are 4.4 mW and 3.1 mW, the voltages are 6.7 V and 5.3 V.

Further, the carbon nanotube strip 180 has a small thickness and is very apt to be broken. The carbon nanotube wire 190 is much stronger by having the carbon nanotubes shrunk together. Therefore, the incandescent light source display 100 using the carbon nanotube wires 190 has a relatively longer life time.

Compared with the conventional CRT display, the incandescent light source display 100 does not need a phosphor layer and an anode panel, and thus has a very simple structure. Compared with the conventional LCD display, the incandescent light source display 100 does not have a view angle limitation. Further, the size of the carbon nanotube wire 190 can be very small, and the resolution of the incandescent light source display 100 can be very high.

An embodiment of a method for making an incandescent light source includes steps of:

S1', providing a substrate and a drawn carbon nanotube film comprising a plurality of carbon nanotubes substantially aligned along a same direction;

S2', forming a first electrode and a second electrode spaced from the first electrode on a surface of the substrate;

S3', covering the first electrode and second electrode with the drawn carbon nanotube film, the drawn carbon nanotube film suspending between the first electrode and the second electrode and having the plurality of carbon nanotubes substantially aligned an X direction from the first electrode to the second electrode;

S4', cutting the drawn carbon nanotube film between the first electrode and the second electrode along the X direction to form at least one carbon nanotube strip;

S5', shrinking the at least one carbon nanotube strip into at least one carbon nanotube wire by using an organic solvent; and S6', sealing the substrate with the first electrode, the second electrode, and the at least one carbon nanotube strip in a sealing case.

According to this embodiment of the method for making the incandescent light source there is no need to form the driving circuit and break off the carbon nanotube film.

It is to be understood that the above description and the claims drawn to a method may include some indication in reference to certain steps. However, the indication used is only to be viewed for identification purposes and not as a suggestion as to an order for the steps.

Finally, it is to be understood that the above-described embodiments are intended to illustrate rather than limit the disclosure. Variations may be made to the embodiments without departing from the spirit of the disclosure as claimed. Elements associated with any of the above embodiments are envisioned to be associated with any other embodiments. The above-described embodiments illustrate the scope of the disclosure but do not restrict the scope of the disclosure.

What is claimed is:

1. A method for making an incandescent light source display comprising steps:

providing a substrate and a drawn carbon nanotube film comprising a plurality of carbon nanotubes substantially aligned along a same direction;

forming a plurality of electrode pairs on a surface of the substrate, the surface of the substrate defining a plurality of pixel locations, the plurality of electrode pairs being spaced from each other and located on the plurality of pixel locations in one to one manner, each of the plurality of electrode pairs comprising a first electrode and a second electrode spaced from the first electrode;

covering the plurality of electrode pairs with the drawn carbon nanotube film, the drawn carbon nanotube film suspending between the first electrode and the second electrode and having the plurality of carbon nanotubes substantially aligned an X direction from the first electrode to the second electrode in each of the plurality of electrode pairs;

cutting the drawn carbon nanotube film between the first electrode and the second electrode along the X direction to form at least one carbon nanotube strip in each of the plurality of pixel locations;

removing the drawn carbon nanotube film between any adjacent two of the plurality of pixel locations; and shrinking the at least one carbon nanotube strip into at least one carbon nanotube wire by using an organic solvent.

2. The method of claim 1, wherein at least one of the first electrode and the second electrode is a heat dissipation electrode having a height in a range from about 10 microns to about 100 microns.

3. The method of claim 1, wherein the drawn carbon nanotube film is drawn from a carbon nanotube array.

4. The method of claim 1, wherein the cutting the drawn carbon nanotube film comprises scanning the drawn carbon nanotube film by a laser beam or an electron beam.

5. The method of claim 1, wherein the cutting the drawn carbon nanotube film forms a plurality of carbon nanotube strips in each of the plurality of pixel locations, wherein the plurality of carbon nanotube strips are spaced from each other.

6. The method of claim 5, wherein the plurality of carbon nanotube strips in each of the plurality of pixel locations are connected together by a portion of the drawn carbon nanotube film located on the first electrode and the second electrode.

7. The method of claim 5, wherein the shrinking the at least one carbon nanotube strip comprises shrinking the plurality of carbon nanotube strips into a plurality of carbon nanotube wires spaced from each other.

8. The method of claim 1, wherein the plurality of pixel locations are arranged as a pixel array having pixel lines and pixel columns, the X direction is parallel to the pixel lines, the cutting the drawn carbon nanotube film is processed pixel line by pixel line having a cutting route along the X direction and continuously passing through the first electrode and the second electrode of each of the plurality pixel locations in a same pixel line.

9. The method of claim 8, wherein after a pixel line i and before a pixel line i+1, the cutting route goes between the pixel line i and the pixel line i+1, to remove the drawn carbon nanotube film between the pixel line i and the pixel line i+1.

10. The method of claim 1, wherein the shrinking the at least one carbon nanotube strip comprises soaking the at least one carbon nanotube strip with the organic solvent and removing the organic solvent from the at least one carbon nanotube strip.

11. The method of claim 10, wherein the shrinking the at least one carbon nanotube strip further comprises atomizing the organic solvent into a fine spray around the at least one carbon nanotube strip to apply the organic solvent to the at least one carbon nanotube strip.

12. The method of claim 1, wherein a diameter of the at least one carbon nanotube wire is in a range from about 100 nanometers to about 1 micron.

13. The method of claim 1, wherein a width of the at least one carbon nanotube strip is in a range from about 3 microns to about 30 microns.

14. The method of claim 1 further comprising a step of sealing the substrate, with the first electrode and the second electrode, and the at least one carbon nanotube wire therein, in vacuum or a protective gas in a sealing case.

15. The method of claim 1 further comprising a step of forming a heat dissipation device on a portion of the drawn carbon nanotube film in contact with at least one of the first electrode and the second electrode.

16. A method for making an incandescent light source display comprising steps:

providing a substrate and a drawn carbon nanotube film comprising a plurality of carbon nanotubes substantially aligned along a same direction;

forming a first electrode and a second electrode spaced from the first electrode on a surface of the substrate;

covering the first electrode and the second electrode with the drawn carbon nanotube film, the drawn carbon nanotube film suspending between the first electrode and the second electrode and having the plurality of carbon nanotubes substantially aligned an X direction from the first electrode to the second electrode;

cutting the drawn carbon nanotube film between the first electrode and the second electrode along the X direction to form at least one carbon nanotube strip;

shrinking the at least one carbon nanotube strip into at least one carbon nanotube wire by using an organic solvent; and sealing the substrate with the first electrode, the second electrode, and the at least one carbon nanotube strip in a sealing case.

17. The method of claim 16, wherein the cutting the drawn carbon nanotube film comprises a step of scanning the drawn carbon nanotube film by a laser beam or an electron beam.

* * * * *